US008356643B2

(12) United States Patent
Schulz et al.

(10) Patent No.: US 8,356,643 B2
(45) Date of Patent: Jan. 22, 2013

(54) HOT FILLING SYSTEM WITH HEAT RECOVERY

(75) Inventors: Danilo Schulz, Straubing (DE); Volker Richter, Regensburg (DE); Torsten Runge, Straubing (DE)

(73) Assignee: Krones AG, Neutraubling (DE)

( * ) Notice: Subject to any disclaimer, the term of this patent is extended or adjusted under 35 U.S.C. 154(b) by 632 days.

(21) Appl. No.: 12/614,636

(22) Filed: Nov. 9, 2009

(65) Prior Publication Data

US 2010/0139214 A1 Jun. 10, 2010

(30) Foreign Application Priority Data

Nov. 10, 2008 (DE) ..... 10 2008 056 597

(51) Int. Cl.
*B65B 63/08* (2006.01)

(52) U.S. Cl. ..... 141/11; 141/69; 141/120; 53/127; 53/440

(58) Field of Classification Search ..... 141/11, 141/69, 82, 120; 53/127, 440; 99/470; 165/66
See application file for complete search history.

(56) References Cited

U.S. PATENT DOCUMENTS 3,451,471 A 6/1969 Palm
5,415,882 A * 5/1995 Knipper et al. ..... 426/237
5,465,655 A * 11/1995 Papetti ..... 99/455
5,533,441 A * 7/1996 Reznik et al. ..... 99/455
7,694,858 B2 * 4/2010 Takeda et al. ..... 222/424
2005/0112258 A1 5/2005 Feldmeier
2006/0137761 A1 6/2006 Takeda et al.
2009/0007522 A1 * 1/2009 Sakai et al. ..... 53/426

FOREIGN PATENT DOCUMENTS

DE 102005053005 A1 5/2007
EP 1598308 A1 * 11/2005
EP 2184257 B1 9/2011
WO WO-03082354 A1 10/2003
WO WO-2007046067 A1 4/2007

OTHER PUBLICATIONS

T. Herty: Molchbare Pasteuranlage mit kontinuierlicher Vakuumentgasung, Flüssiges Obst, 8/2202, 508-510.

* cited by examiner

*Primary Examiner* — Timothy L Maust
*Assistant Examiner* — Robert Bell, III

(57) ABSTRACT

A hot filling system for a liquid, with heat recovery, and a corresponding method, wherein prior to heating and filling the liquid is first preheated in a heat exchanger. A portion of the heated liquid to be filled is again cooled in a recooler and recirculated. The return line of the recooler is here connected to the supply line of the heat exchanger so as to transfer heat energy from the recooler to the heat exchanger. This reduces energy losses in comparison with known systems.

13 Claims, 2 Drawing Sheets

HOT FILLING SYSTEM WITH HEAT RECOVERY

CROSS-REFERENCE TO RELATED APPLICATION

The present application claims the benefit of priority of German patent application DE 102008056597, filed Nov. 10, 2008 . The entire text of the priority application is incorporated herein by reference.

FIELD OF THE DISCLOSURE

The present disclosure relates to a hot filling system for a liquid, particularly a drink, with heat recovery, the system comprising: a heat exchanger for preheating the liquid to a first temperature; a heater arranged downstream of the heat exchanger for heating the liquid to a second temperature higher than the first temperature; a first distributor arranged downstream of the heater for dividing the liquid e.g. into a portion to be filled into bottles, jars, bags, or the like, and into a portion to be returned to the inlet of the heat exchanger; a bottle filler arranged downstream of the first distributor for filling the liquid into bottles; and a recooler arranged downstream of the first distributor for cooling the portion to be returned.

BACKGROUND

Hot filling after pasteurizing, e.g. in a short-time heater, is an established method for filling drinks into bottles or bags in a preserved or durable condition. The untreated drink is preheated, degassed and then pasteurized as a rule. After the filling process, e.g. at 85° C., the filled bottles are cooled in a bottle cooling device with the help of a coolant stream, e.g. by way of spraying, to a temperature of e.g. 30° C. that is suited for further processing.

It is known from T. Herty: Molchbare Pasteuranlage mit kontinuierlicher Vakuumentgasung, Flüssiges Obst, 8/2002, 508-510 that during the hot filling of drinks, particularly at a standstill of the bottle filler, already pasteurized liquid is cooled in a recooler and is admixed again via a buffer to the untreated liquid.

It is moreover known from DE 10 2005 053 005 A1 that hot-filled beverage bags are cooled by a coolant stream and the coolant stream is circulated such that the absorbed heat is again discharged to the drink to be heated.

The heat withdrawn from the filled bottles or bags is e.g. passed into a heat exchanger for preheating the liquid to be treated. By contrast, the heat withdrawn during recooling of the liquid that has not been filled is disposed off in known hot filling systems in a cooling tower and represents an energy loss. This must also be taken into account during failure-free normal operation when a specific portion of the heated liquid that has not been filled yet is recooled and again admixed to the untreated liquid so as to stabilize the operation of the system.

SUMMARY OF THE DISCLOSURE

It is an aspect of the present disclosure to reduce the energy loss during hot filling as compared with known systems.

This aspect is achieved with a hot filling system. Hence, the return line of the recooler is connected to the supply line of the heat exchanger so as to transmit heat energy from the recooler to the heat exchanger.

As a result, the liquid can be preheated with heat recovered during recooling and energy losses can be reduced.

Preferably, the first distributor passes the liquid substantially completely through the recooler at a standstill of the bottle filler. This maximizes the energy amount available for recovery.

Preferably, the hot filling system comprises a second distributor that adjusts a portion of a heat transport medium to be fed from the recooler into the heat exchanger. The heating power to be transmitted can thereby be metered in a selective way.

In a further preferred development of the disclosure the first distributor divides the liquid during operation of the bottle filler such that the portion to be returned accounts for 10-15% of the portion to be filled. This ensures a stable control of the system.

Preferably, the hot filling system further comprises a bottle cooler for cooling the filled bottles, the bottle cooler having a return line connected to the supply line of the heat exchanger to transmit heat energy from the bottle cooler to the heat exchanger. As a result, the heat energy released during cooling can be recovered and used again for heating the liquid.

In a development of the disclosure the hot filling system further comprises a third distributor that passes heat transport medium from the return line of the bottle cooler selectively into the heat exchanger or the supply line of the bottle cooler. As a result, the recovered amount of heat can be controlled in a targeted way and the heat transport medium can be circulated in case of need.

It is advantageous when the third distributor passes the heat transport medium from the return line of the bottle cooler into the supply line of the bottle cooler when no bottles are cooled in the bottle cooler. This delays an unintended cooling of the bottle cooler.

Preferably, the supply temperature of the heat exchanger is 60-75° C. This enables a particularly efficient heat recovery.

The underlying aspect is further achieved with a method for hot filling liquids. Thus the liquid is preheated with heat energy recovered during recooling of the portion to be returned.

Preferably, the portion to be returned is set such that it accounts for 10-15% of the portion to be filled in the bottling process. This ensures a stable control of the system.

Preferably, the liquid is completely returned upon interruption of the bottling process. This maximizes the energy amount available for the recovering process.

Preferably, the method further comprises the following steps: cooling the filled bottles; and preheating the liquid with heat energy recovered during cooling of the bottles. The heat energy released during cooling can thereby be recovered and used again for heating the liquid.

Preferably, the liquid is preheated upon interruption of the bottling process with heat energy recovered during cooling of the bottles and with heat energy recovered during recooling. This ensures a preheating as constant as possible during the standstill period and minimizes the amount of energy to be fed from additional heat sources during preheating.

Preferably, the heat energy recovered during cooling of the bottles is used for preheating the liquid only for a period as long as bottles are being cooled. This prevents a situation where a device used for the bottle cooling process cools down rapidly.

BRIEF DESCRIPTION OF THE DRAWINGS

A preferred embodiment is described in the drawing, in which.

DETAILED DESCRIPTION OF THE PREFERRED EMBODIMENT

Figure 1:
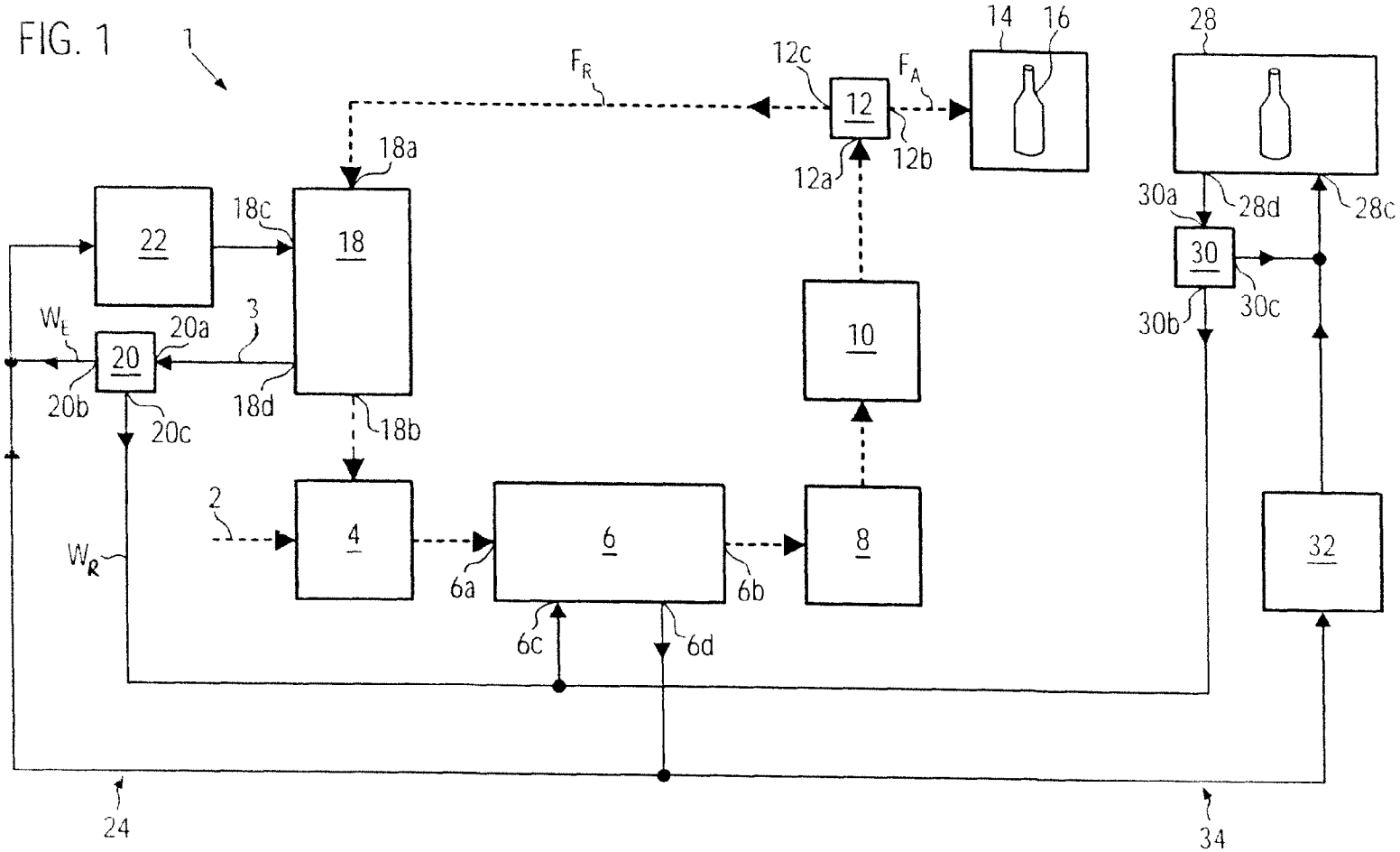
FIG. 1 shows a diagram of a hot filling system according to the disclosure.

FIG. 1 schematically shows a hot filling system 1 for a liquid 2, particularly a drink. The arrows shown in broken line represent the flow direction of the liquid 2; the arrows shown in continuous line represent the flow direction of a heat transport medium 3, such as e.g. water.

Accordingly the hot filling system 1 comprises a collecting vessel 4 for temporarily storing the liquid 2 to be treated and filled, the vessel having arranged downstream thereof in series a heat exchanger 6, a preheater 8, a heater 10 and a first adjustable three-way distributor 12 with an inlet 12*a* and two outlets 12*b* and 12*c*.

The heat exchanger 6 comprises an inlet 6*a* and an outlet 6*b* for the liquid 2 and a supply line 6*c* and a return line 6*d* for the heat transport medium 3 and preheats the liquid 2 to a preheat temperature TV, which is e.g. needed for conventional degassing of the liquid in a degassing apparatus (not shown).

In case of need the preheater 8 additionally preheats the liquid 2, e.g. in the case of an insufficient heating power of the heat exchanger 6 or upon start of the system 1.

In the heater 10, the liquid 2 is heated to a treatment temperature TB that is higher than the preheating temperature TV.

The first distributor 12 distributes the liquid 2 flowing out of the heater 10 into a portion FA to be filled and into a portion FR to be returned into the product circuit or the collecting vessel 4. Accordingly the outlet 12*b* of the first distributor 12 has arranged downstream thereof a bottler 14 which fills the liquid portion FA into bottles 16. The outlet 12*c* has arranged downstream thereof a recooler 18 with an inlet 18*a* and an outlet 18*b* for the liquid 2, as well as a supply line 18*c* and a return line 18*d* for the heat transport medium 3. The outlet 18*b* of the recooler 18 leads back to the collecting vessel 4.

The recooler 18 forms a first heat transport medium circuit 24 together with a second adjustable three-way distributor 20, the heat exchanger 6 and a first cooling tower 22. The inlet 20*a* of the second distributor 20 is fed from the return line 18*d* of the recooler 18 and divides the stream of the heat transport medium 3 into a portion WE for external heat disposal in the first cooling tower 22 and into a portion WR for heat recovery in the heat exchanger 6. Accordingly an outlet 20*b* of the second distributor 20 is connected to the supply line of the first cooling tower 22; the other outlet 20*c* is connected to the supply line 6*c* of the heat exchanger 6.

The hot filling system 1 further comprises a bottle cooler 28 for cooling the filled bottles 16. Said cooler comprises a supply line 28*c* and a return line 28*d* for the heat transport medium 3 and forms a second heat transport medium circuit 34 with a third adjustable three-way distributor 30, the heat exchanger 6 and a second cooling tower 32. The inlet 30*a* of the third distributor 30 is here fed from the return line 28*d* of the bottle cooler 28 and passes the heat transport medium 3 heated in the bottle cooler 28 in a first position via the outlet 30*b* to the supply line 6*c* of the heat exchanger so as to transmit heat energy from the bottle cooler 28 to the heat exchanger 6. In a second position the third distributor 30 shorts the supply line 28*c* and the return line 28*d* of the bottle cooler 28 via the outlet 30*c*.

The liquid 2 is e.g. a drink, such as water, milk, juice, beer, lemonade, or another liquid, which is treated by the action of heat and is filled in the heated state. The liquid may contain an emulsion, suspension and/or foam.

The heat exchanger 6 may e.g. be a conventional plate or tube heat exchanger and is preferably operated at a supply temperature of 50-80° C. In FIG. 1 both heat transport medium circuits 24 and 34 are respectively connected in parallel with the supply line 6*c* and the return line 6*d* for the sake of clarity. The circuits, however, could just as well be separated from each other, e.g. by check valves, by a separate supply and return line 6*c*, 6*d* for each circuit or by a two-stage configuration of the heat exchanger 6. It is decisive that both circuits 24, 34 can be used for preheating the liquid 2 and combined and optimized in case of need. Likewise, the cooling towers 22 and 32 and their cooling capacity, respectively, and the respective volume flows could be connected and controlled in a way differing from that shown in FIG. 1 as long as they fulfill the described function.

The preheater 8 can e.g. be heated with steam.

The heater 10 is e.g. a conventional, steam-operated short-time heater with a heat holding path on which the liquid 2 to be treated is held at the treatment temperature TB for a specific period of time, e.g. for pasteurizing. The heater 10 may comprise a correction cooler (not shown) to set the treated liquid 2 to a temperature suited for bottling, e.g. 85° C. The heat quantity withdrawn from the liquid 2 in this process is returned, as much as possible, to the inlet of the heater 10 to heat subsequent inflowing liquid 2.

The distributor 12 is e.g. an electrically controlled mixing valve with which the liquid portions FR and FA can be varied in relation with each other in a way as finely graduated as possible or continuously and can also be set such that the liquid 2 is passed exclusively to the bottle filler 14 or to the recooler 18.

The bottle filler 14 fills the heated liquid 2 as supplied to it in a conventional way continuously into bottles 16. The bottles 16 may e.g. be made from glass or plastic. Other containers, such as bags, may be filled just as well.

The filled bottles 16 are cooled in the bottle cooler 28 e.g. by being sprayed with water to a temperature suited for further processing, e.g. 30° C. The bottle cooler 28 may e.g. be designed as a multistage cooling tunnel. The bottle cooler 28 may e.g. be designed such that a return temperature that is as high as possible is achieved, e.g. in the range of 50° C. to 80° C. so as to optimize the heat recovery efficiency on the heat exchanger 6. This can e.g. be achieved by designing individual cooling stages of the cooling tunnel in an appropriate way and/or by increasing the residence time of the bottles 16 in the bottle cooler 28 or by reducing the volume flow of the heat transport medium 3 through the bottle cooler 28.

The third distributor 30 is preferably an electrically controlled switching valve that passes the heated heat transport medium 3 flowing out of the return line 28*d* of the bottle cooler 28, either completely to the supply line 6*c* of the heat exchanger 6, or, however by way of shorting, returns it to the supply line 28*c* of the bottle cooler 28. The shorting operation prevents or delays a cooling of the bottle cooler 28 in cases where temporarily no filled bottles 16 enter the bottle cooler 28. The third distributor 30, however, could also be configured as a mixing valve.

The recooler 18 is preferably configured such that a return temperature that is as high as possible is achieved, e.g. 50-80° C., to achieve a heat recovery efficiency on the heat exchanger 6 that is as high as possible. The liquid 2 should here be cooled down approximately to the temperature of the untreated liquid 2, e.g. to a temperature of about 20-40° C. before it mixes in the collecting vessel 4 with untreated liquid 2.

With the hot filling system 1 according to the disclosure it is possible to work in the following way during normal operation after the respective desired temperatures have been reached and with a continuous filling of the bottles 16 and their introduction into the bottle cooler 28:

Liquid 2 is continuously passed from the collecting vessel 4 through the heat exchanger 6, whereby it is heated to a preheating temperature TV. If the heating capacity of the heat exchanger 6 is insufficient, the liquid 2 is additionally heated up in the preheater 8 to the temperature TV. The liquid 2 is subsequently treated e.g. in a vacuum degassing process (not shown) and/or other processes and passed to the heater 10. In this heater the liquid 2 is heated, for instance for pasteurizing, to a treatment temperature TB for a certain period of time, where: TB>TV. A portion FA of the treated liquid 2 is passed into the bottle filler 14 and filled in this bottle filler into bottles 16 at a temperature of preferably 80-90° C. The remaining portion FR of the treated liquid 2 is passed into the recooler 18; it is cooled therein to 20-40° C. and returned again into the collecting vessel 4. The proportionate return of the liquid 2 during normal operation ensures a stable operation of the filling system. As a consequence, a situation can for example be prevented where liquid 2 must be discarded due to lack of sterility caused by delayed filling. The ratio FR/FA is 0.05-0.2 during normal operation. Preferably, the ratio FR/FA is 0.1-0.15.

The predominant portion of the heating power that is available in the heat exchanger 6 during normal operation derives from the bottle cooler 28. The ratio of the heating powers available from the heat transport medium circuits 24 and 34 on the return lines 18*d* and 28*d*, respectively, corresponds approximately to the ratio FR/FA during normal operation.

The heat recovery in the bottle cooler 28 and in the recooler 18 and in the heat medium circuits 34 and 24, respectively, may be combined to minimize the energy losses in the filling system 1 during normal operation and/or to optimize the control thereof.

With the hot filling system 1 according to the disclosure it is possible to operate in case of failure, particularly at a standstill of the bottle filler 14, as follows:

Upon stop of the bottle filler 14 the whole heated liquid 2 should be circulated under normal operation conditions so as to be able to swiftly re-continue the filling operation.

Figure 2:
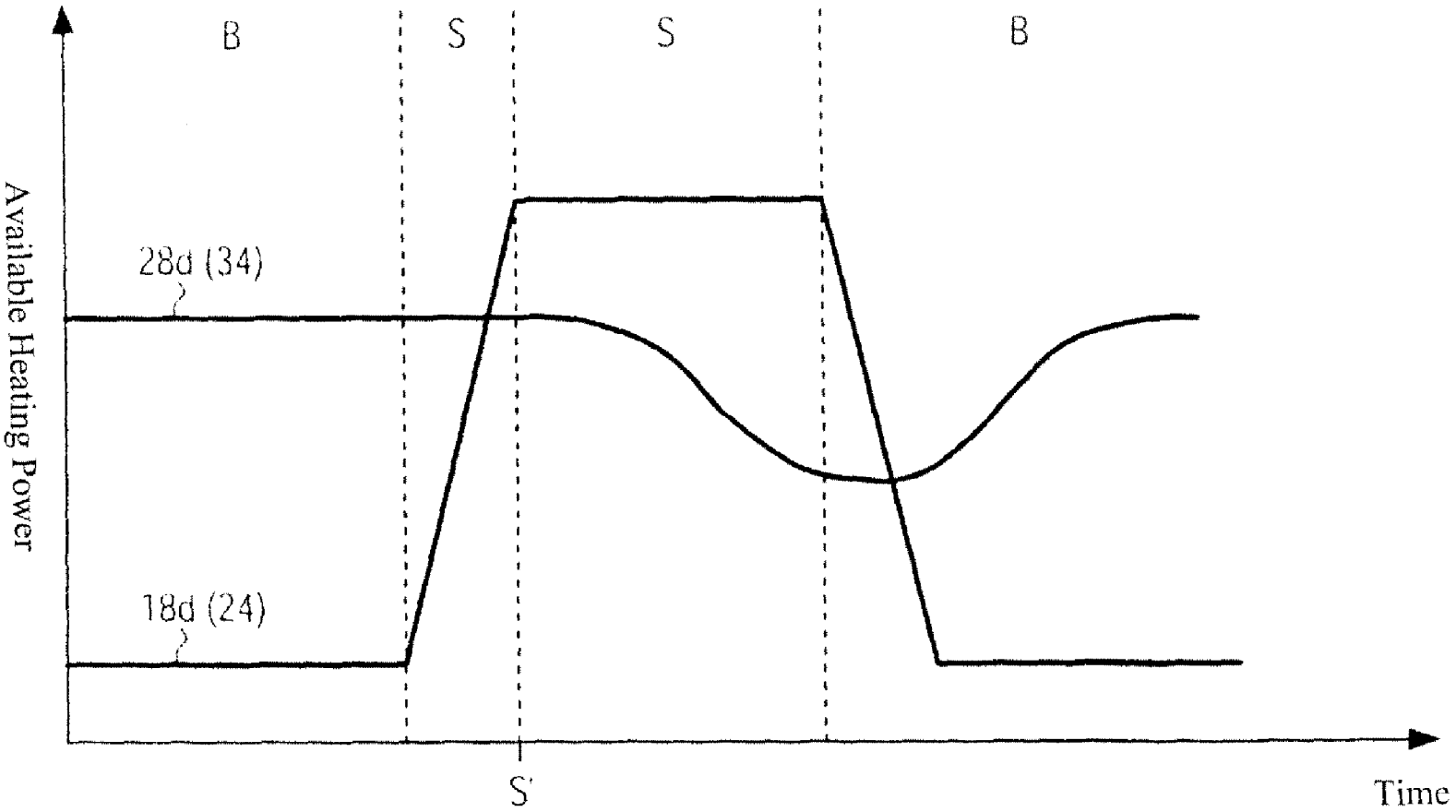
FIG. 2 shows a diagrammatic curve of the heating power available for heat recovery when the bottle filling process is temporarily stopped.

FIG. 2 shows the heating power potentially available for energy recovery in the circuits 24 and 34 during operation B and during a temporary standstill S of the bottle filler 14. During normal operation there are substantially time-constant heat quantities available from circuits 24 and 34, respectively.

Upon stop of the bottle filler 14 the whole liquid 2 is passed from the first distributor 12 into the recooler 18 and is cooled in said recooler approximately to the start temperature of the untreated liquid 2. This will increase the heating power available on the return line 18*d* of the recooler 18 until said power corresponds to the output power of the bottle cooler 14 during normal operation.

Even after the bottle filler 14 has been stopped, already filled bottles 16 are still transported to the bottle cooler 28, so that the same heating power as during normal operation is at first still available on the return line 28*d* of the bottle cooler 28, e.g. for a period of two minutes. Starting from time S', after all of the conveyed bottles 16 have been cooled, the heating power available on the bottle cooler 28 is decreasing continuously. As can be seen from FIG. 2, the available heat output power of the bottle cooler 28 is normally increasing or decreasing at a slower pace than that of the recooler 18.

To delay the cooling of the bottle cooler 28, the third distributor 30 shorts the supply line 28*c* and the return line 28*d* of the bottle cooler 28 at time S' and simultaneously prevents that the supply line 28*c* is fed from the second cooling tower 32.

When the operation of the bottle filler 14 is resumed, the first distributor 12 is again reset to normal operation so that only the original liquid portion FR is passed to the recooler 18. As a result, the heating power available on the return line 18*d* of the recooler 18 is again decreasing to the value prevailing during normal operation.

Since the available heat output power of the bottle cooler 28 is rising at a slower pace than the power of the recooler 18 is decreasing, as shown in FIG. 2, the heating power available on the heat exchanger 6 on the whole may temporarily fall below a minimum value needed for preheating the liquid 2, so that additional heating power must be applied by the preheater 8 for this purpose.

Due to the combined heat recovery in the bottle cooler 28 and in the recooler 18 and in the heat medium circuits 34 and 24, respectively, the liquid 2 can predominantly be preheated by recovered energy and an additional external energy input can considerably be reduced in comparison with conventional systems.

The invention claimed is:

1. A hot filling system (1) for liquids, particularly drinks, with heat recovery, comprising:

a heat exchanger (6) for preheating the liquid (2) to a first temperature ($T_v$);

a heater (10) arranged downstream of the heat exchanger (6) for heating the liquid (2) to a second temperature ($T_B$) higher than the first temperature ($T_v$);

a first distributor (12) arranged downstream of the heater (10) for dividing the liquid (2) into a portion ($F_A$) to be filled into bottles (16) and into a portion ($F_R$) to be returned to the inlet (6*a*) of the heat exchanger (6);

a bottle filler (14) arranged downstream of the first distributor (12) for filling the liquid (2) into bottles (16); and a recooler (18) arranged downstream of the first distributor (12) for cooling the portion ($F_R$) to be returned, the return line (18*d*) of the recooler (18) is connected to the supply line (6*c*) of the heat exchanger (6) to transmit heat energy from the recooler (18) to the heat exchanger (6), and wherein the system further comprises a second distributor (20) which separates a portion ($W_R$) of a heat transport medium (3) that is to be fed from the recooler (18) into the heat exchanger (6).

2. The hot filling system according to claim 1, wherein the first distributor (12) passes the liquid (2) substantially completely through the recooler (18) at a standstill of the bottle filler (14).

3. The hot filling system according to claim 1, wherein the first distributor (12) divides the liquid (2) during operation of the bottle filler (14) such that the portion ($F_R$) to be returned accounts for 10-15% of the portion ($F_A$) to be filled.

4. The hot filling system according to claim 1, wherein the system further comprises a bottle cooler (28) for cooling the filled bottles (16), the bottle cooler (28) having a return line (28*d*) connected to the supply line (6*c*) of the heat exchanger (6) to transmit heat energy from the bottle cooler (28) to the heat exchanger (6).

5. The hot filling system according to claim 4, wherein the system further comprises a third distributor (30) which passes heat transport medium (3) from the return line (28*d*) of the bottle cooler (28) selectively into one of the heat exchanger (6) or the supply line (28*c*) of the bottle cooler (28).

6. The hot filling system according to claim 5, wherein the third distributor (30) passes the heat transport medium (3) from the return line (28*d*) of the bottle cooler (28) into the supply line (28*c*) of the bottle cooler (28) when no bottles (16) are cooled in the bottle cooler (28).

7. The hot filling system according to claim 1, wherein the supply temperature of the heat exchanger (6) is 60 to 75° C.

8. A method for hot filling liquids, particularly drinks, with heat recovery, the method comprising the following steps:

preheating the liquid (2) to a first temperature ($T_v$);

heating the liquid (2) to a second temperature ($T_B$) higher than the first temperature ($T_v$);

dividing the heated liquid (2) into a portion ($F_A$) to be filled into bottles (16) and into a portion ($F_R$) to be recirculated for renewed preheating;

filling the portion ($F_A$) to be filled into bottles (16);

recooling the portion ($F_R$) to be returned, preheating the liquid (2) with heat energy recovered during recooling of the portion ($F_R$) to be returned, and separating a portion of a heat transport medium that is to be fed from the recooling step to the preheating step.

9. The method according to claim 8, wherein the portion ($F_R$) to be returned is set such that it accounts for approximately 10 to 15% of the portion ($F_A$) to be filled in the bottling process.

10. The method according to claim 8, wherein the liquid (2) is completely returned upon interruption of the bottling process.

11. The method according to claim 8, and further comprising the following steps:

cooling the filled bottles; and preheating the liquid (2) with heat energy recovered during cooling of the bottles.

12. The method according to claim 11, wherein upon interruption of the bottling process, preheating the liquid (2) with heat energy recovered during cooling of the bottles and with heat energy recovered during recooling.

13. The method according to claim 12, wherein heat energy recovered during cooling of the bottles is not used to preheat the liquid at anytime other than while the bottles are simultaneously being cooled.

* * * * *